US005283501A

United States Patent [19]

Zhu et al.

[11] Patent Number: 5,283,501

[45] Date of Patent: Feb. 1, 1994

[54] ELECTRON DEVICE EMPLOYING A LOW/NEGATIVE ELECTRON AFFINITY ELECTRON SOURCE

[75] Inventors: Xiaodong T. Zhu, Chandler; James E. Jaskie, Scottsdale, both of Ariz.; Robert C. Kane, Woodstock, Ill.

[73] Assignee: Motorola, Inc., Schaumburg, Ill.

[21] Appl. No.: 732,298

[22] Filed: Jul. 18, 1991

[51] Int. Cl.[5] ..... H05B 41/00

[52] U.S. Cl. ..... 315/169.3; 315/169.4; 313/346 R; 257/77

[58] Field of Search ..... 315/349, 169.3, 169.4; 313/309, 311, 336, 351, 346 R; 257/77, 11

[56] References Cited

U.S. PATENT DOCUMENTS

| | | | |
|---|---|---|---|
| 3,699,404 | 10/1972 | Simon et al. | 257/11 |
| 4,040,074 | 8/1977 | Hara et al. | 357/16 |
| 4,084,942 | 4/1978 | Villalobos | 313/311 |
| 4,498,952 | 2/1985 | Christensen | 313/309 |
| 4,721,885 | 1/1988 | Brodie | 313/309 X |
| 4,908,539 | 3/1990 | Meyer | 313/309 X |
| 5,180,951 | 1/1993 | Dworsky et al. | 315/169.4 |

FOREIGN PATENT DOCUMENTS 02-20337 9/1990 Japan ..... 313/311

OTHER PUBLICATIONS

M. W. Geis, J. A. Gregory, B. B. Pate, "Capacitance-Voltage measurements on metal-$SiO_2$-diamond structures fabricated with (100)-and (111)-oriented substrates," IEEE Trans. Electron Devices, vol. 38, pp. 619-626, Mar. 1991.

*Primary Examiner*—Eugene R. LaRoche
*Assistant Examiner*—Son Dinh
*Attorney, Agent, or Firm*—Eugene A. Parsons

[57] ABSTRACT

Electron devices employing electron sources including a material having a surface exhibiting a very low/negative electron affinity such as, for example, the 111 crystallographic plane of type II-B diamond. Electron sources with geometric discontinuities exhibiting radii of curvature of greater than approximately 1000Å are provided which substantially improve electron emission levels and relax tip/edge feature requirements. Electron devices employing such electron sources are described including image generation electron devices, light source electron devices, and information signal amplifier electron devices.

34 Claims, 10 Drawing Sheets

500

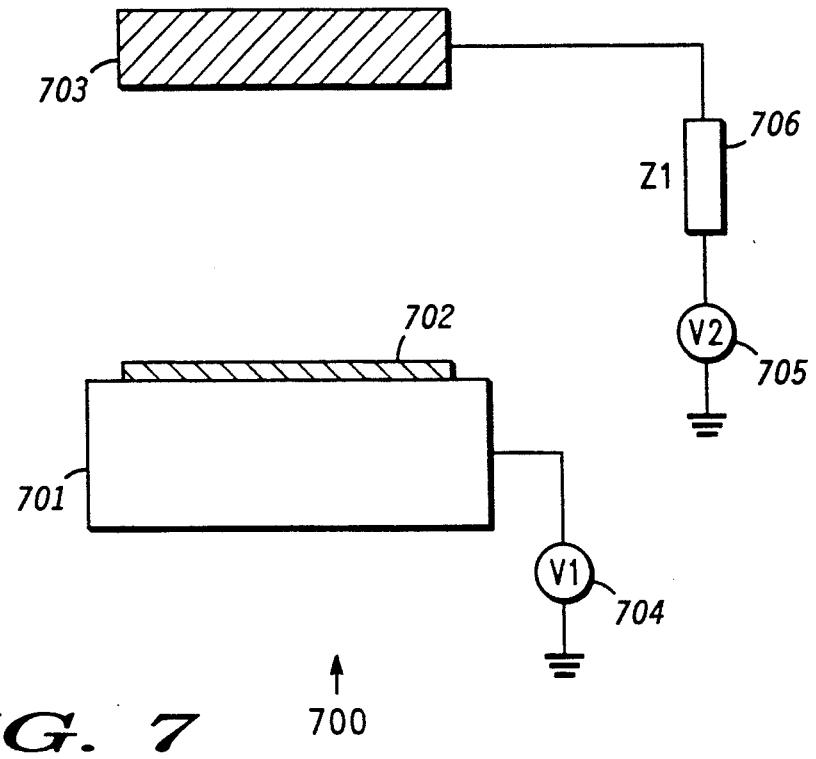
FIG. 7
FIG. 8
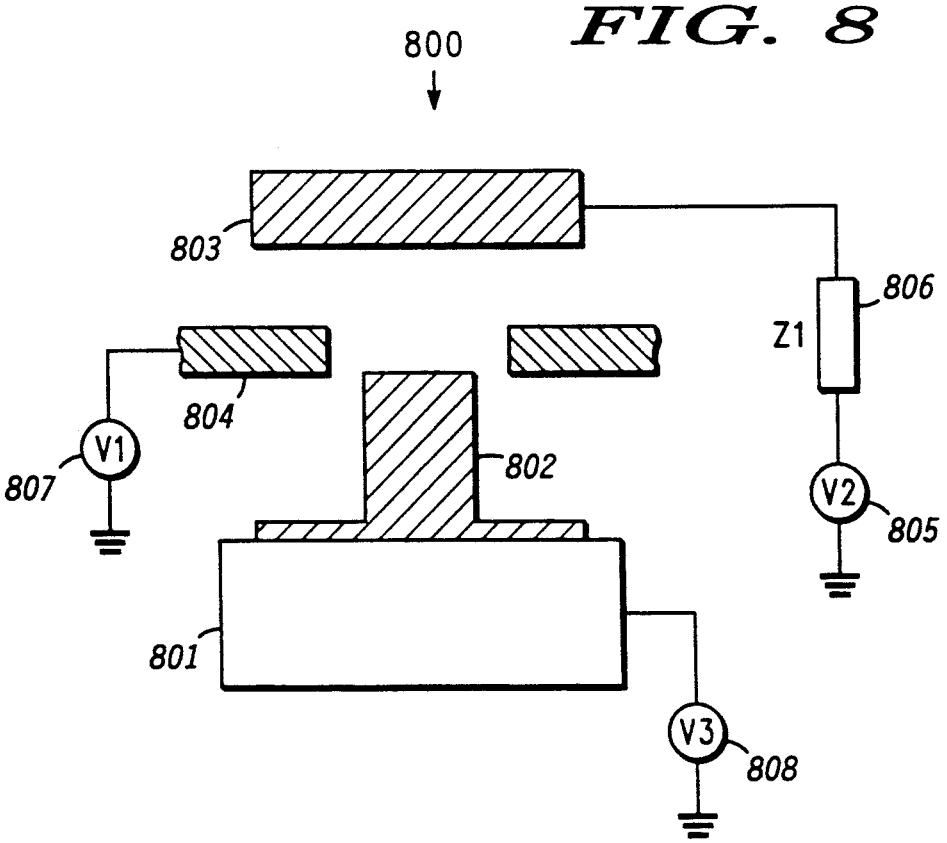

ELECTRON DEVICE EMPLOYING A LOW/NEGATIVE ELECTRON AFFINITY ELECTRON SOURCE

FIELD OF THE INVENTION

The present invention relates generally to electron devices and more particularly to electron devices employing free-space transport of electrons.

BACKGROUND OF THE INVENTION

Electron devices employing free space transport of electrons are known in the art and commonly utilized as information signal amplifying devices, video information displays, image detectors, and sensing devices. A common requirement of this type of device is that there must be provided, as an integral part of the device structure, a suitable source of electrons and a means for extracting these electrons from the surface of the source.

A first prior art method of extracting electrons from the surface of an electron source is to provide sufficient energy to electrons residing at or near the surface of the electron source so that the electrons may overcome the surface potential barrier and escape into the surrounding free-space region. This method requires an attendant heat source to provide the energy necessary to raise the electrons to an energy state which overcomes the potential barrier.

A second prior art method of extracting electrons from the surface of an electron source is to effectively modify the extent of the potential barrier in a manner which allows significant quantum mechanical tunneling through the resulting finite thickness barrier. This method requires that very strong electric fields must be induced at the surface of the electron source.

In the first method the need for an attendant energy source precludes the possibility of effective integrated structures in the sense of small sized devices. Further, the energy source requirement necessarily reduces the overall device efficiency since energy expended to liberate electrons from the electron source provides no useful work.

In the second method the need to establish very high electric fields, on the order of $1\times10^7$V/cm, results in the need to operate devices by employing objectionably high voltages or by fabricating complex geometric structures.

Accordingly there exists a need for electron devices employing an electron source which overcomes at least some of the shortcomings of the electron sources of the prior art.

SUMMARY OF THE INVENTION

This need and others are substantially met through provision of an electron device with an electron source including a material which exhibits an inherent affinity to retain electrons disposed at/near a surface of the material which is less than approximately 1.0 electron volt. Alternatively, an electron device electron source including a material which exhibits an inherent negative affinity to retain electrons disposed at/near a surface may be provided.

It is anticipated that electron sources with geometric discontinuities exhibiting radii of curvature of greater than approximately 1000Å will provide substantially improved electron emission levels and, consequently, a relaxation of the tip/edge feature requirements. This relaxation of the tip/edge feature requirement is a significant improvement since it provides for dramatic simplification of methods employed to realize electron source devices.

In a realization of the electron source of the present invention the material is diamond.

In an embodiment of an electron device utilizing an electron source in accordance with the present invention a substantially uniform light source is provided.

In another embodiment of an electron device utilizing an electron source in accordance with the present invention an image display device is provided.

In yet other embodiments of electron devices employing electron sources in accordance with the present invention three terminal signal amplifying devices are provided.

BRIEF DESCRIPTION OF THE DRAWINGS

FIG. 7 is a cross sectional/schematic representation of another embodiment of an electron device realized by employing a reduced/negative electron affinity electron source in accordance with the present invention.

FIG. 8 is a side-elevational cross sectional depiction of another embodiment of an electron device realized by employing a reduced/negative electron affinity electron source in accordance with the present invention.

DETAILED DESCRIPTION OF PREFERRED EMBODIMENTS

Figure 1A:
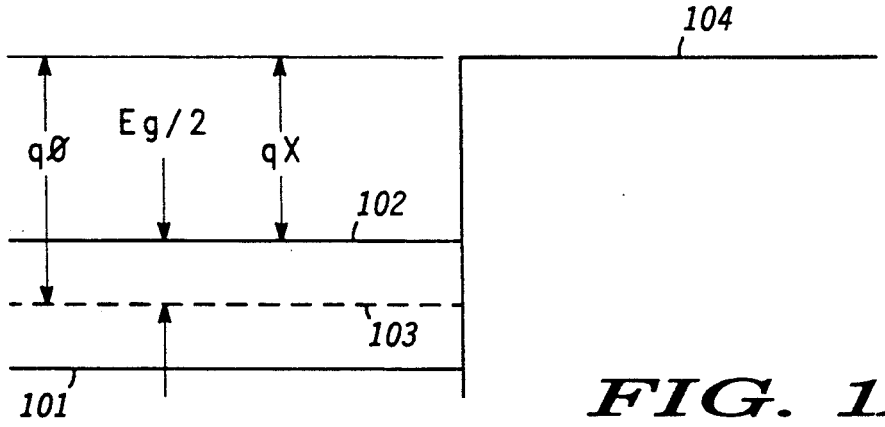
FIGS. 1A & 1B are schematic depictions of typical semiconductor to vacuum surface energy barrier representations.

Referring now to FIG. 1A there is shown a schematic representation of the energy barrier for a semiconductor to vacuum interface. The semiconductor material surface characteristic is detailed as an upper energy level of a valance band 101, a lower energy level of a conduction band 102 and an intrinsic Fermi energy level 103 which typically resides midway between the upper level of the valance band 101 and the lower level of the conduction band 102. A vacuum energy level 104 is shown in relation to the energy levels of the semiconductor material wherein the disposition of the vacuum energy level 104 at a higher level than that of the semiconductor energy levels indicates that energy must be provided to electrons disposed in the semiconductor material in order that such electrons may possess sufficient energy to overcome the barrier which inhibits spontaneous emission from the surface of the semiconductor material into the vacuum space.

For the semiconductor system under consideration the energy difference between the vacuum energy level 104 and the lower level of the conduction band 102 is referred to as the electron affinity, qX. The difference in energy levels between the lower level of the conduction band 102 and the upper energy level of the valance band 101 is generally referred to as the band-gap, Eg. In the instance of undoped (intrinsic) semiconductor material the difference between the intrinsic Fermi energy level 103 and the lower energy level of the conduction band 102 is one half the band-gap, Eg/2. As shown in the depiction of FIG. IA, it will be necessary to augment the energy content of an electron disposed at the lower energy level of the conduction band 102 to raise it to an energy level corresponding to the free-space energy level 104.

A work function, qϕ, is defined as the energy which must be added to an electron which resides at the intrinsic Fermi energy level 103 so that the electron may overcome the potential barrier to escape the surface of the material in which it is disposed. For the system of FIG. 1A:

$$q\phi = qX + Eg/2$$

Figure 1B:
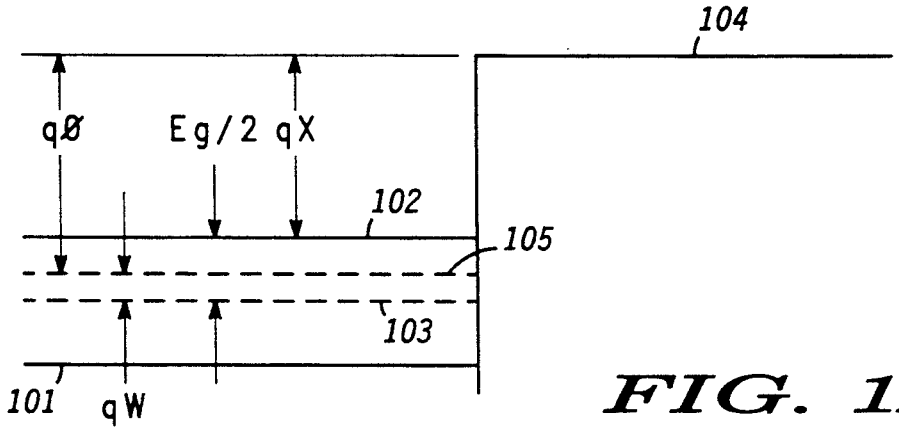

FIG. 1B is a schematic energy barrier representation as described previously with reference to FIG. 1A wherein the semiconductor material depicted has been impurity doped in a manner which effectively shifts the energy levels such that a Fermi energy level 105 is realized at an energy level higher than that of the intrinsic Fermi energy level 103. This shift in energy levels is depicted by an energy level difference, qW, which yields a corresponding reduction in the work function of the system. For the system of FIG. 1B:

$$q\phi = qX + Eg/2 - qW$$

Clearly, although the work function is reduced the electron affinity, qX, remains unchanged by modifications to the semiconductor material.

Figure 2A:
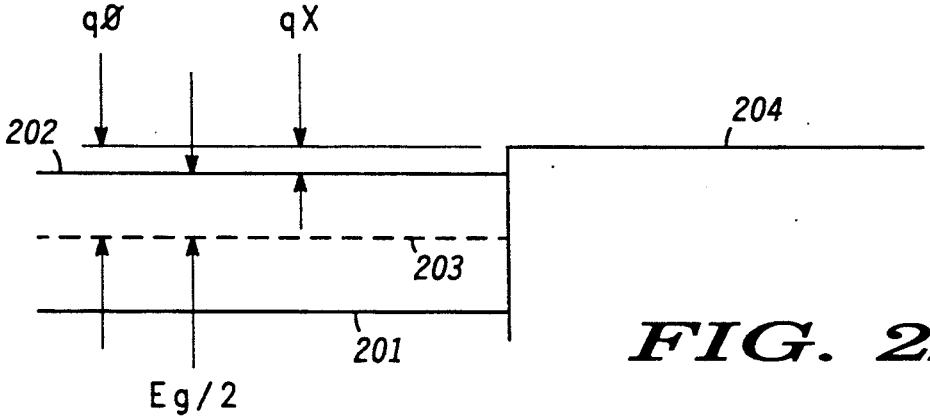
FIGS. 2A & 2B are schematic depictions of reduced electron affinity semiconductor to vacuum surface energy barrier representations.

FIG. 2A is a schematic representation of an energy barrier as described previously with reference to FIG. 1A wherein similar features are designated with similar numbers and all of the numbers begin with the numeral "2" to indicate another embodiment. FIG. 2A further depicts a semiconductor material wherein the energy levels of the semiconductor surface are in much closer proximity to the vacuum energy level 204 than that of the previously described system. In the instance of diamond semiconductor material it is observed that the electron affinity, qX, is less than 1.0 eV (electron volt). For the system of FIG. 2A:

$$q\phi = Eg/2 + qX$$

Figure 2B:
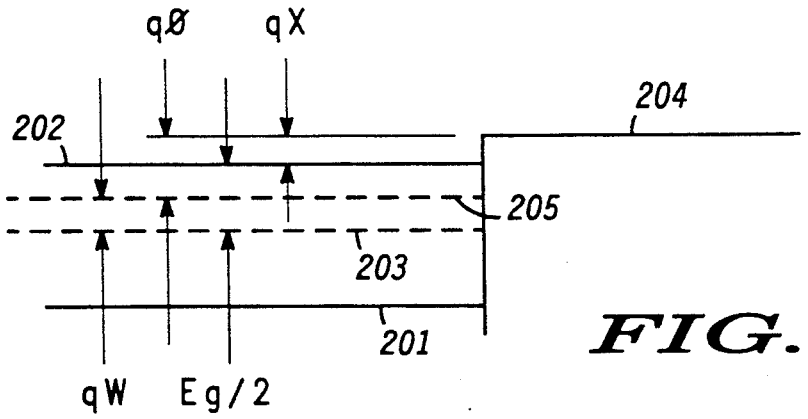

Referring now to FIG. 2B there is depicted an energy barrier representation as described previously with reference to FIG. 2A wherein the semiconductor system has been impurity doped such that an effective Fermi energy level 205 is disposed at an energy level higher than that of the intrinsic Fermi energy level 203. For the system of FIG. 2*b*:

$$q\phi = Eg/2 - qW + qX$$

Figure 3A:
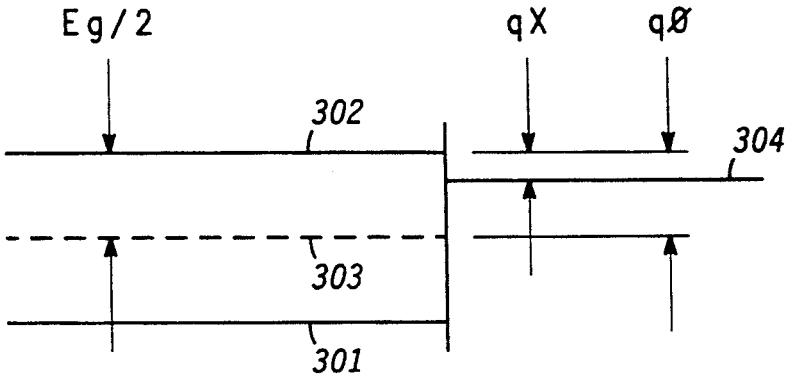
FIGS. 3A & 3B are schematic depictions of negative electron affinity semiconductor to vacuum surface energy barrier representations.

FIG. 3A is a schematic energy barrier representation as described previously with reference to FIG. 1A wherein reference designators corresponding to similar features depicted in FIG. IA are referenced beginning with the numeral "3". FIG. 3A depicts a semiconductor material system having an energy level relationship to the vacuum energy level 304 such that the level of the lower energy level 302 of the conduction band is higher than the level of the vacuum energy level 304. In such a system electrons disposed at or near the surface of the semiconductor material and having energy corresponding to any energy state in the conduction band will be spontaneously emitted from the surface of the semiconductor material. This is typically the energy characteristic of the 111 crystallographic plane of diamond. For the system of FIG. 3A:

$$q\phi = Eq/2$$

since an electron must still be raised to the conduction band before it is subject to emission from the semiconductor surface.

Figure 3B:
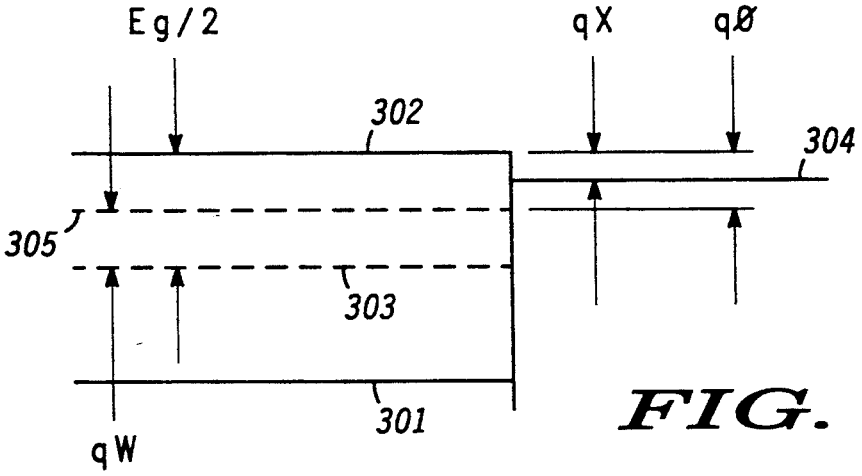

FIG. 3B is a schematic energy barrier representation as described previously with reference to FIG. 3A wherein the semiconductor material has been impurity doped as described previously with reference to FIG. 2B. For the system of FIG. 3B:

$$q\phi = Eq/2 - qW$$

For the electron device electron source under consideration in the present disclosure electrons disposed at or near the surface of diamond semiconductor material will be utilized as a source of electrons for electron device operation. As such it is necessary to provide a means by which emitted electrons are replaced at the surface by electrons from which the semiconductor bulk. This is found to be readily accomplished in the instance of type II-B diamond since the electrical conductivity of intrinsic type II-B diamond, on the order of 50Ωcm, is suitable for many applications. For those applications wherein the electrical conductivity must be increased above that of intrinsic type II-B diamond suitable impurity doping may be provided. Intrinsic type II-B diamond employing the 111 crystallographic plane is unique among materials in that it possesses both a negative electron affinity and a high intrinsic electrical conductivity.

Figure 4A:
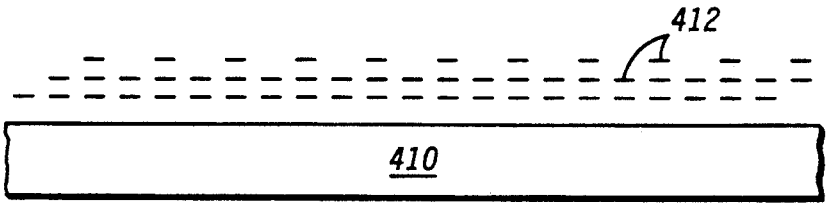
FIGS. 4A–4B are schematic depictions of structures utilized in an embodiment of an electron device employing reduced/negative electron affinity electron sources in accordance with the present invention.

FIG. 4A is a side-elevational cross-sectional representation of an electron source 410 in accordance with the present invention. Electron source 410 includes a diamond semiconductor material having a surface corresponding to the 111 crystallographic plane and wherein any electrons 412 spontaneously emitted from the surface of the diamond material reside in a charge cloud immediately adjacent to the semiconductor surface. In equilibrium, electrons will be liberated from the surface of the semiconductor material at a rate equal to that at which electrons are re-captured by the semiconductor surface. As such, no net flow of charge carriers takes place within the bulk of the semiconductor material.

Figure 4B:
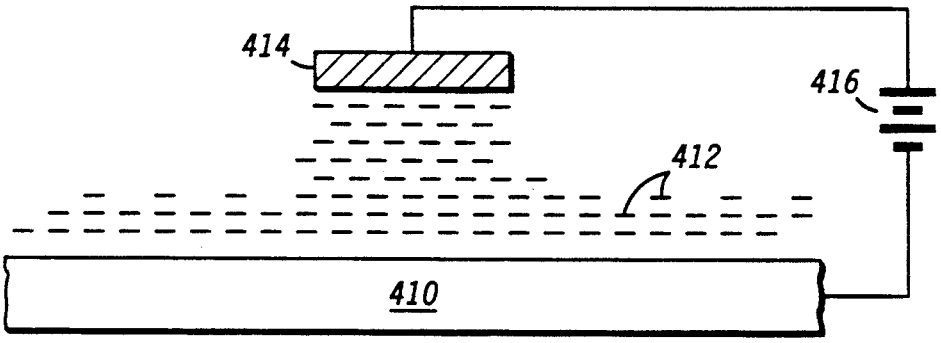

FIG. 4B is a side-elevational cross-sectional representation of a first embodiment of an electron device 400 employing an electron source 410 in accordance with the present invention as described previously with reference to FIG. 4A. Device 400 further includes an anode 414, distally disposed with respect to electron source 410, and also depicts an externally provided voltage source 416, operably coupled between anode 414 and electron source 410. By employing externally provided voltage source 416 to induce an electric field in the intervening region between anode 414 and electron source 410, electrons 412 residing above the surface of electron source 410 move toward and are collected by anode 414. As the density of electrons 412 disposed above electron source 410 is reduced due to movement towards anode 414 the equilibrium condition described earlier is disturbed. In order to restore equilibrium, additional electrons are emitted from the surface of electron source 410, which electrons must be replaced at the surface by available electrons within the bulk of the material. This gives rise to a net current flow within the semiconductor material of electron source 410, which is facilitated by the high electrical conductivity characteristics of type II-B diamond.

In the instance of type II-B diamond semiconductor material employing the surface corresponding to the 111 crystallographic plane only a very small electric field need be provided to induce electrons 412 to be collected by anode 414. This electric field strength may be on the order of 1.0KB/cm which corresponding to 1 volt when anode 414 is disposed at a distance of 1 micron with respect to electron source 410. Prior art techniques, employed to provide electric field induced electron emission from materials typically require electric fields greater than 10MV/cm.

Figure 5:
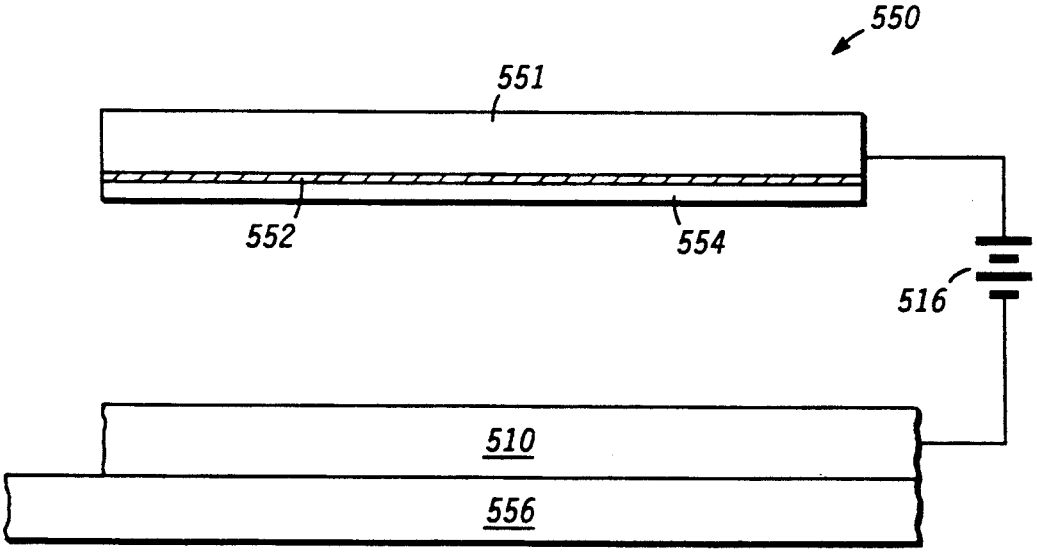
FIG. 5 is a schematic depiction of another embodiment of an electron device realized by employing a reduced/negative electron affinity electron source in accordance with the present invention.

FIG. 5 is a side-elevational cross-sectional depiction of a second embodiment of an electron device 500 employing an electron source 510 in accordance with the present invention. A supporting substrate 556 having a first major surface is shown whereon electron source 510 having an exposed surface exhibiting a low to a negative electron affinity (less than approximately 1.0eV to less than approximately 0.0eV) is disposed. An anode 550 is distally disposed with respect to the electron source 510.

Anode 550 includes a layer of substantially optically transparent faceplate material 551 having a surface, directed toward electron source 510, which is substantially parallel to and spaced from the surface of electron source 510. A substantially optically transparent conductive layer 552 is disposed on the surface of faceplate material 551 with a surface directed toward electron source 510. Conductive layer 552 has disposed on the surface directed toward electron source 510 a layer 554 of cathodoluminescent material, for emitting photons.

An externally provided voltage source 516 is operably coupled to conductive layer 552 and to electron source 510 in such a manner that an induced electric field in the intervening region between anode 550 and electron source 510 gives rise to electron movement toward anode 550 as described above. Electrons moving through the induced electric field will acquire additional energy and strike layer 554 of cathodoluminescent material. The electrons impinging on layer 554 of cathodoluminescent material give up this excess energy, at least partially, by radiative processes which take place in the cathodoluminescent material to yield photon emission through substantially optically transparent conductive layer 552 and substantially optically transparent faceplate material 551.

Electron device 500 employing an electron source in accordance with the present invention provides a substantially uniform light source as a result of substantially uniform electron emission from electron source 510.

Figure 6:
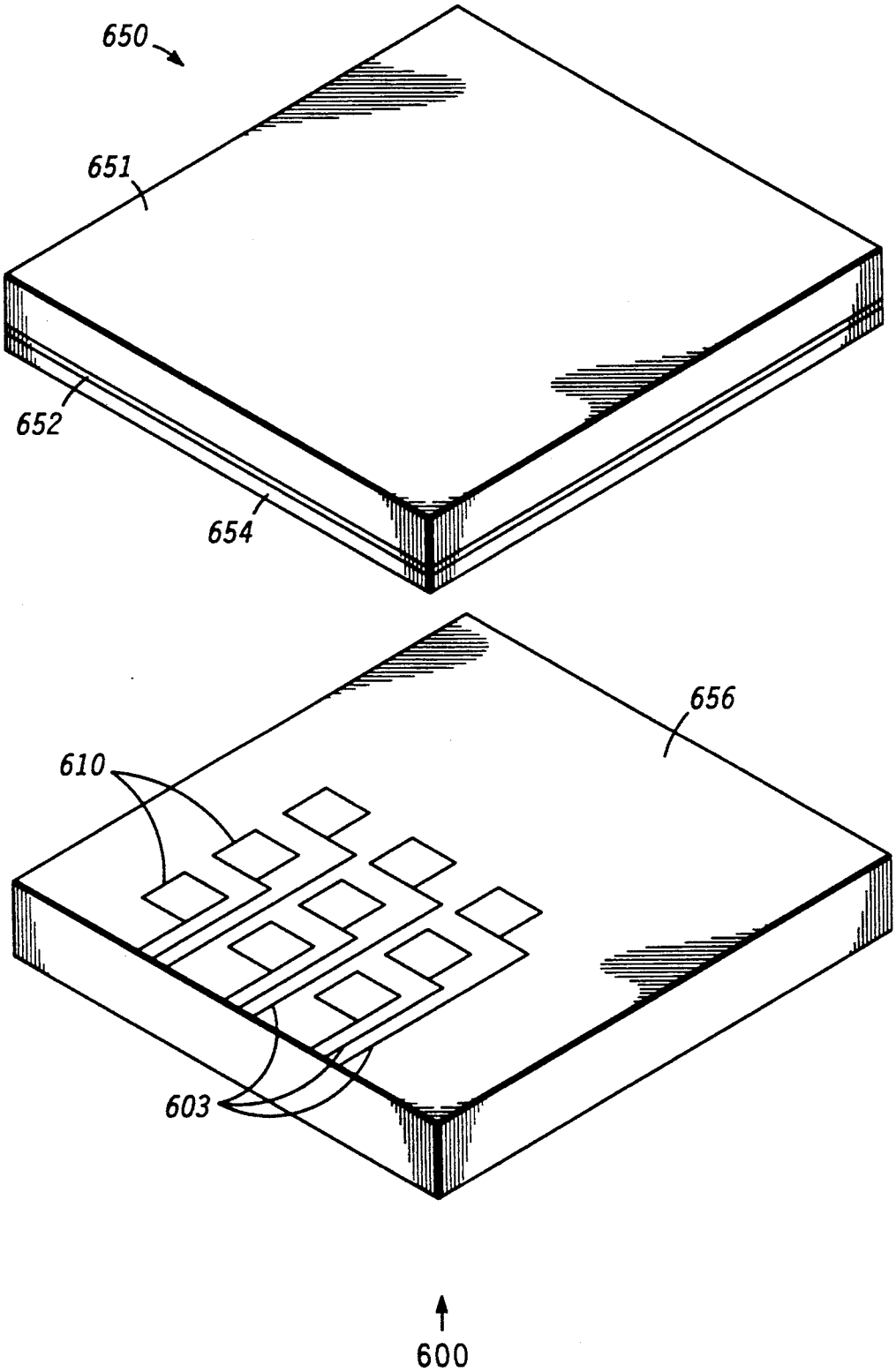
FIG. 6 is a perspective view of a structure employing a plurality of reduced/negative electron affinity electron sources in accordance with the present invention.

FIG. 6 is a perspective view of an electron device 600 in accordance with the present invention as described previously with reference to FIG. 5 wherein reference designators corresponding to similar features depicted in FIG. 5 are referenced beginning with the numeral "6". Device 600 includes a plurality of electron sources 610 and a plurality of conductive paths 603, which are formed for example of a layer of metal, coupled to the plurality of electron sources 610. By forming electron sources 610 of type II-B diamond with an exposed surface corresponding to the 111 crystallographic plane electron sources 610 function as negative electron affinity electron sources as described previously with reference to FIGS. 3A, 3B, 4B, and 5.

By employing an externally provided voltage source (not shown) as described previously with reference to FIG. 5 and by connecting externally provided signal sources (not shown) to at least some of the plurality of conductive paths 603, each of the plurality of electron sources 610 may be independently selected to emit electrons. For example, by supplying a positive voltage, with respect to a reference potential, at conductive layer 652 and provided that the potential of the plurality of electron sources 610 is less positive than the potential of conductive layer 652, electrons will flow to anode 650. However, if externally provided signals, operably coupled to any of the plurality of conductive paths 603, are of a magnitude and polarity to cause the associated electron source 610 to be more positive than the voltage on conductive layer 652, then that particular electron source will not emit electrons to anode 650. In this manner individual electron sources 610 are selectively addressed to emit electrons.

Since the induced electric field in the intervening region between anode 650 and electron sources 610 is substantially uniform and parallel to the transit path of emitted electrons, the emitted electrons are collected at anode 650 over an area of the layer 654 of cathodoluminescent material corresponding to the area of the electron source from which they were emitted. In this manner selective electron emission results in selected portions of layer 654 of cathodoluminescent material being energized to emit photons which in turn provide an image which may be viewed through the faceplate material 651 as described previously with reference to FIG. 5.

FIG. 7 is a side-elevational cross-sectional view of another embodiment of an electron device 700 employing an electron source in accordance with the present invention. A supporting substrate 701 having at least a first major surface on which is disposed an electron source 702 operably coupled to a first externally provided voltage source 704 is shown. An anode 703, distally disposed with respect to electron source 702 is operably coupled to a first terminal of an externally provided impedance element 706. A second externally provided voltage source 705 is operably coupled to a second terminal of impedance element 706.

Electron device 700, including electron source 702 formed of type II-B diamond as described previously with reference to FIGS. 3A & 4B, operably coupled to externally provided sources and impedance elements as described above, provides for information signal amplification by varying the rate of electron emission from the surface of electron source 702 through modulation of voltage source 704 and detecting the subsequent variation in collected electron current by monitoring the corresponding variation in voltage drop across impedance element 706.

Referring now to FIG. 8, there is shown a side-elevational cross-sectional view of another embodiment of an electron device 800 employing an electron source 802 in accordance with the present invention. Electron source 802 is selectively formed such that at least a part of electron source 802 forms a column which is substantially perpendicular with respect to a supporting substrate 801. Electron source 802 is disposed on, and operably coupled to, a major surface of a supporting substrate 801. A controlling electrode 804 is proximally disposed substantially peripherally symmetrically, at least partially about the columnar part of electron source 802. The disposition and supporting structure of controlling electrode 804 is realized by employing any of many methods commonly known in the art such as, for example, by providing insulative dielectric materials to support control electrode 804 structure. An anode 803 is distally disposed with respect to the columnar part of electron source 802 such that at least some of any emitted electrons will be collected at anode 803.

A first externally provided voltage or signal source 807 is operably coupled to controlling electrode 804. A second externally provided voltage source 805 and an externally provided impedance element 806 are operably connected to anode 803 as described previously with reference to FIG. 7. A third externally provided voltage or signal source 808 is operably coupled to supporting substrate 801. Electron device 800 employing electron source 802 with emitting surface characteristics as described previously with reference to FIGS. 3A & 4B functions as a three terminal signal amplifying device wherein information/switching signals are applied by either or both of first and third voltage sources 807 and 808.

In the instance of providing a signal/voltage to the controlling electrode 804, of electron device 800, which lowers the potential in the intervening region near the surface of electron source 802 to such a level that electrons do not transit the intervening distance between anode 803 and electron source 802, electron device 800 is effectively placed in the off state. Correspondingly, providing a signal/voltage at electron source 802 which lowers the potential in the intervening region near the surface of electron source 802 to such a level that electrons do not transit the intervening distance between anode 803 and electron source 802 effectively places device 800 in the off state. Selectively providing the necessary voltages/signals with each of the first and second externally provided voltage sources 807 and 808 to electron device 800 selectively places device 800 in the on state or off state. By selectively modulating the voltages applied as either/both the first and second voltage sources 807 and 808, electron device 800 functions as an information signal amplifying device. Alternatively anode 803 of electron device 800 may be realized as an anode described previously with respect to FIGS. 5 & 6. Such an anode structure employed in concert with the externally provided voltage source switching capability of electron device 800 provides for a fully addressable image generating device.

Figure 10:
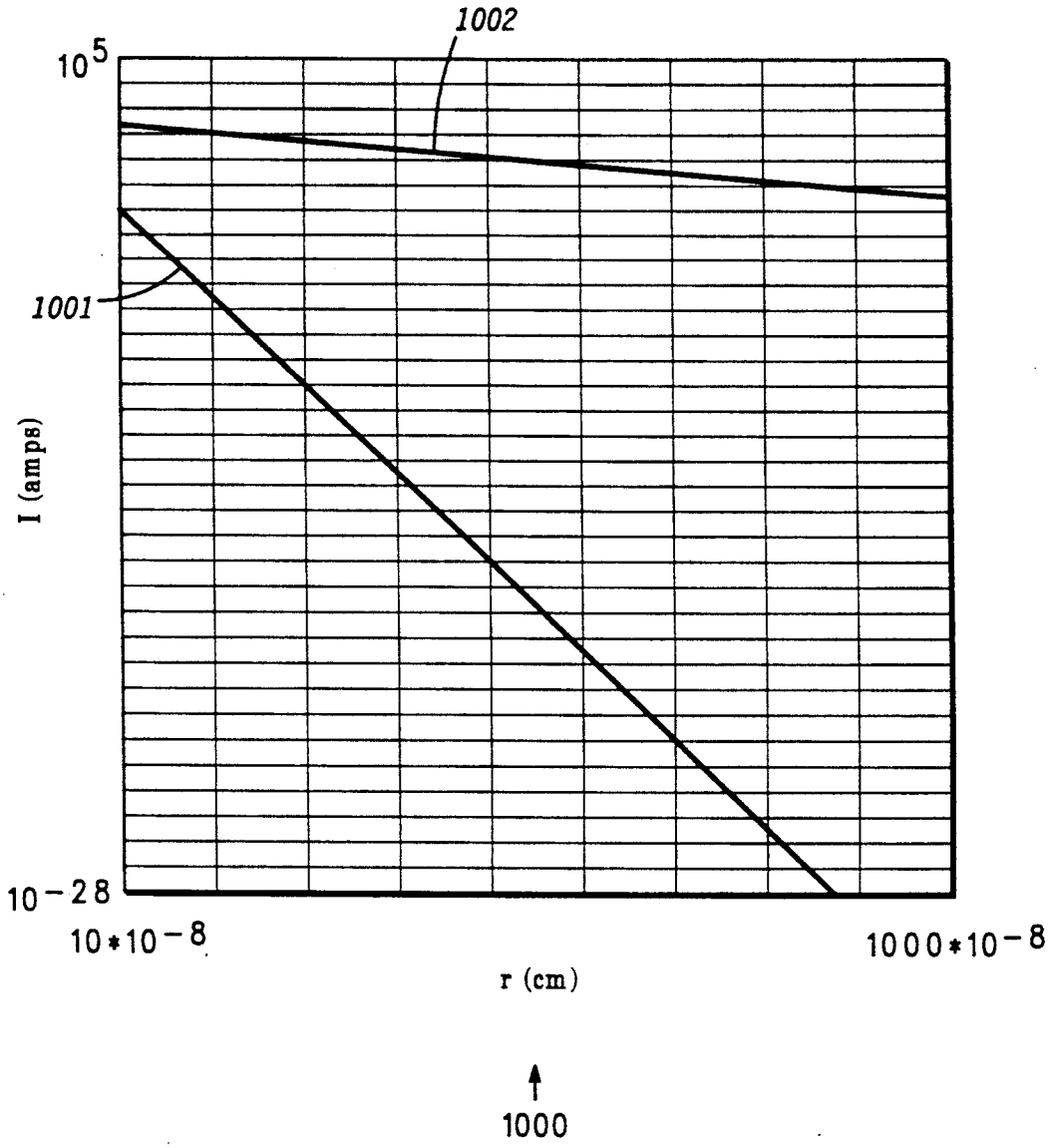
FIG. 10 is a graphical depiction of electric field induced electron emission current vs. emitter radius of curvature.

Referring now to FIG. 10 there is shown a graphical depiction 1000 which represents the relationship between electric-field induced electron emission to the radius of curvature of an electron source. It is known in the art that for electron sources in general such as, for example, conductive tips/edges an externally provided electric field will be enhanced (increased) in the region of a geometric discontinuity of small radius of curvature. Further, the functional relationship for emitted electron current, $$I(r, \phi, V)=1.54\times10^{-6}\times a(r)\times\beta(r)^2\times V^2/(1.1\times q\phi)\times\{-6.83\times10^7\times(q\phi)^{3/2}/(\beta\times V)\times(0.95-1.44\times10^{-7}\times\beta(r)\times V/(q\phi)^2]\}$$

where, $\beta(r)=1/r$ $a(r)=r^2$ and r is given in centimeters includes the parameter, $q\phi$, described previously with reference to FIG. IA as the surface work function. FIG. 10 shows two plots of the electron emission current to radius of curvature. First plot 1001 is determined by setting the work function, $q\phi$, to 5 eV. Second plot 1002 is determined by setting the work function, $q\phi$, to 1eV. In both plots 1001 and 1002 the voltage, v, is set at 100 volts for convenience. The purpose of the graph of FIG. 10 is to illustrate the relationship of emitted electron current, not only to the radius of curvature of an electron source, but also to the surface work function. Clearly, it may be observed that second plot 1002 exhibits electron currents approximately thirty orders of magnitude greater than is the case with first plot 1001 when both are considered at a radius of curvature of 1000Å ($1000\times10^{-10}$m). This relationship, when applied to realization of electron source structures translates directly to a significant relaxation of the requirement that sources exhibit at least some feature of very small radius of curvature. It is shown in FIG. 10 that the electron current of first plot 1001 which employs an electron source with a radius of curvature of 1000Å is still greater than the electron current of second plot 1002 which employs an electron source with a radius of curvature of only 10Å.

Figure 11:
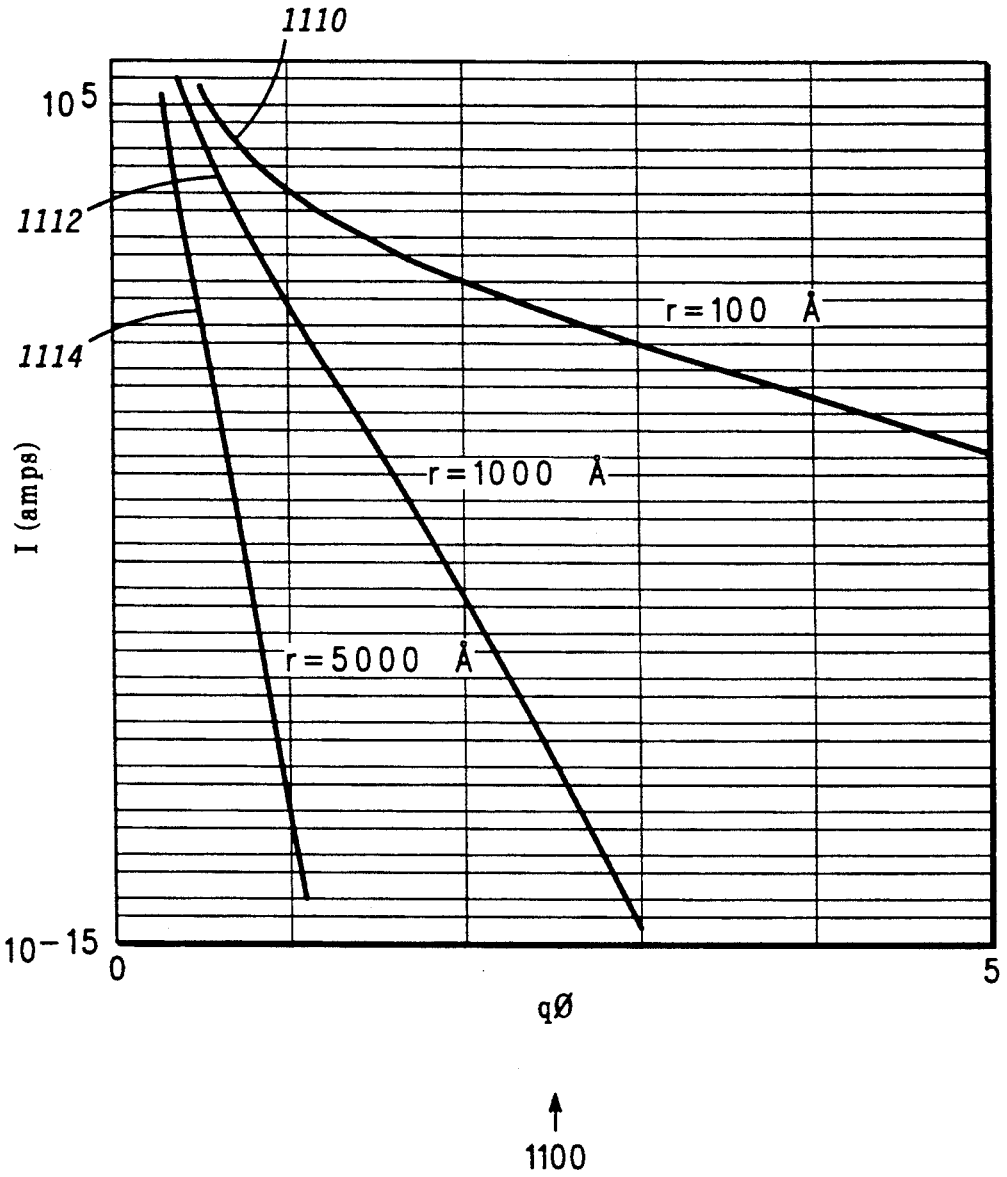
FIG. 11 is a graphical depiction of electric field induced electron emission current vs. surface work function.

FIG. 11 provides a graphical representation 1100 of an alternative way to view the electron current. In FIG. 11 the electron current is plotted vs. work function, $q\phi$, with the radius of curvature, r, as a variable parameter. A first plot 1110 depicts the electron current vs work function for an emitter structure employing a feature with 100Å radius of curvature. Second and third plots 1112 and 1114 depict electron current vs work function for electron sources employing features with 1000Å and 5000Å radius of curvature respectively. For each of plots 1110, 1112 and 1114 it is clearly shown that electron emission increases significantly as work function is reduced and as radius of curvature is reduced. Note also, as with the plots of FIG. 10 that it is clearly illustrated that the current relationship is strongly affected by the work function in a manner which permits a significant relaxation of the requirement that electric field induced electron sources should have a feature exhibiting a geometric discontinuity of small radius of curvature.

Figure 12A:
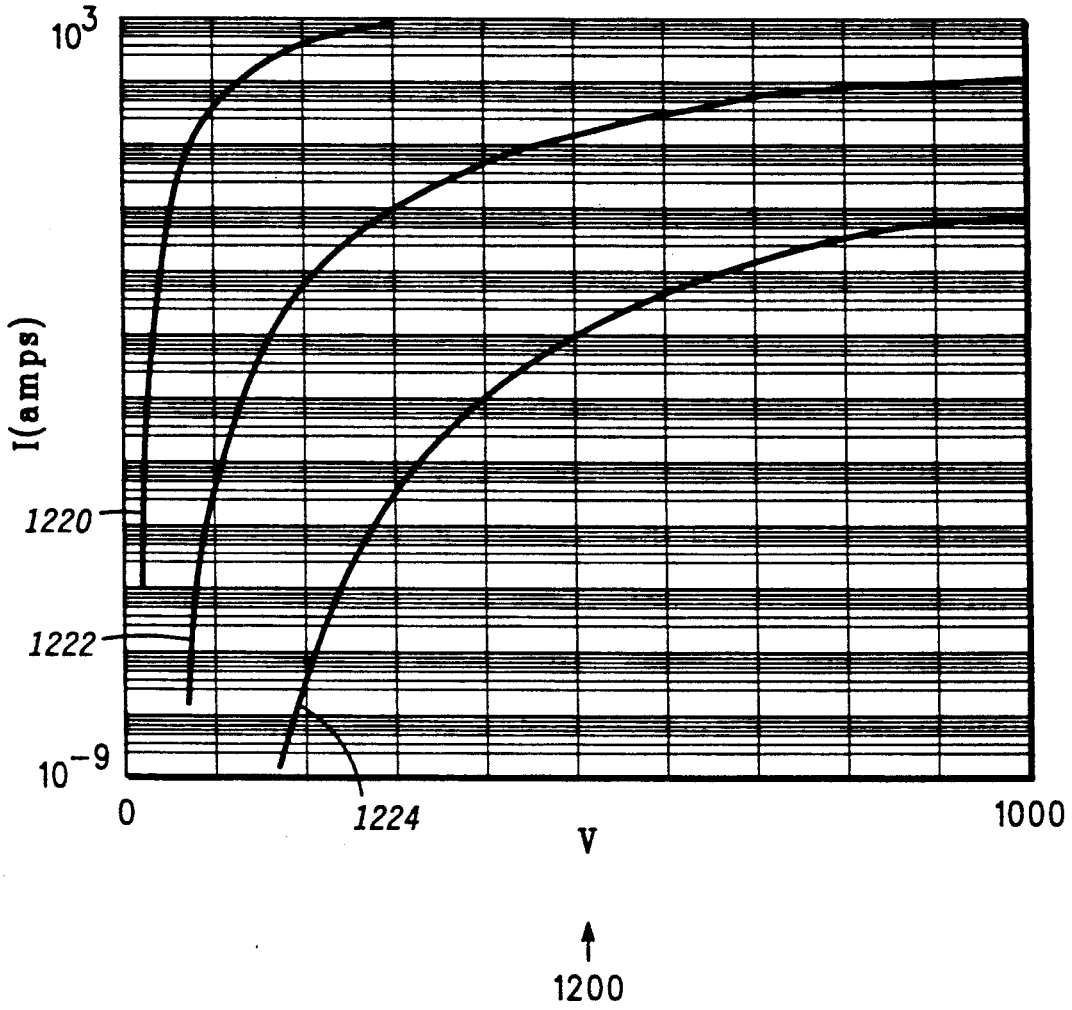
FIGS. 12A–12B are graphical depictions of electric field induced electron emission current vs. applied voltage with surface work function as a variable parameter.

Referring now to FIG. 12A there is depicted a graphical representation 1200 of electron current vs applied voltage, V, with surface work function, $q\phi$, as a variable parameter. First, second, and third plots 1220, 1222 and 1224, corresponding to work functions of 1eV, 2.5ev, and 5eV respectively illustrate that as the work function is reduced the electron current increases by many orders of magnitude for a given voltage. This depiction is consistent with depictions described previously with reference to FIGS. 10 & 11.

Figure 9:
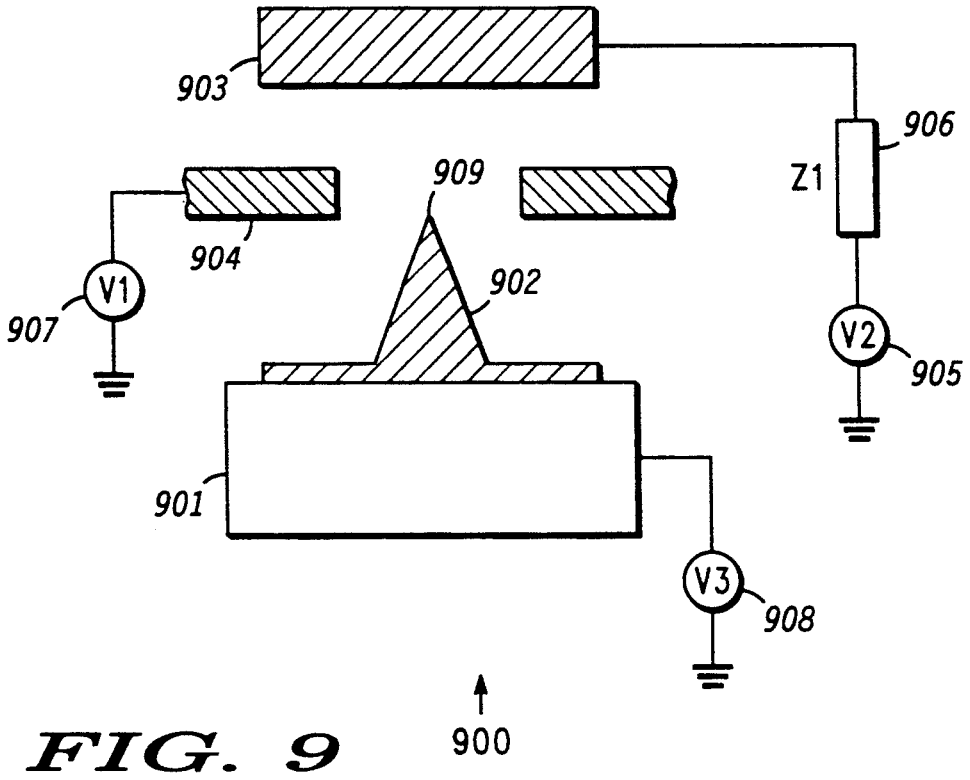
FIG. 9 is a side-elevational cross-sectional depiction of another embodiment of an electron device realized by employing a reduced/negative electron affinity electron source in accordance with the present invention.
Figure 12B:
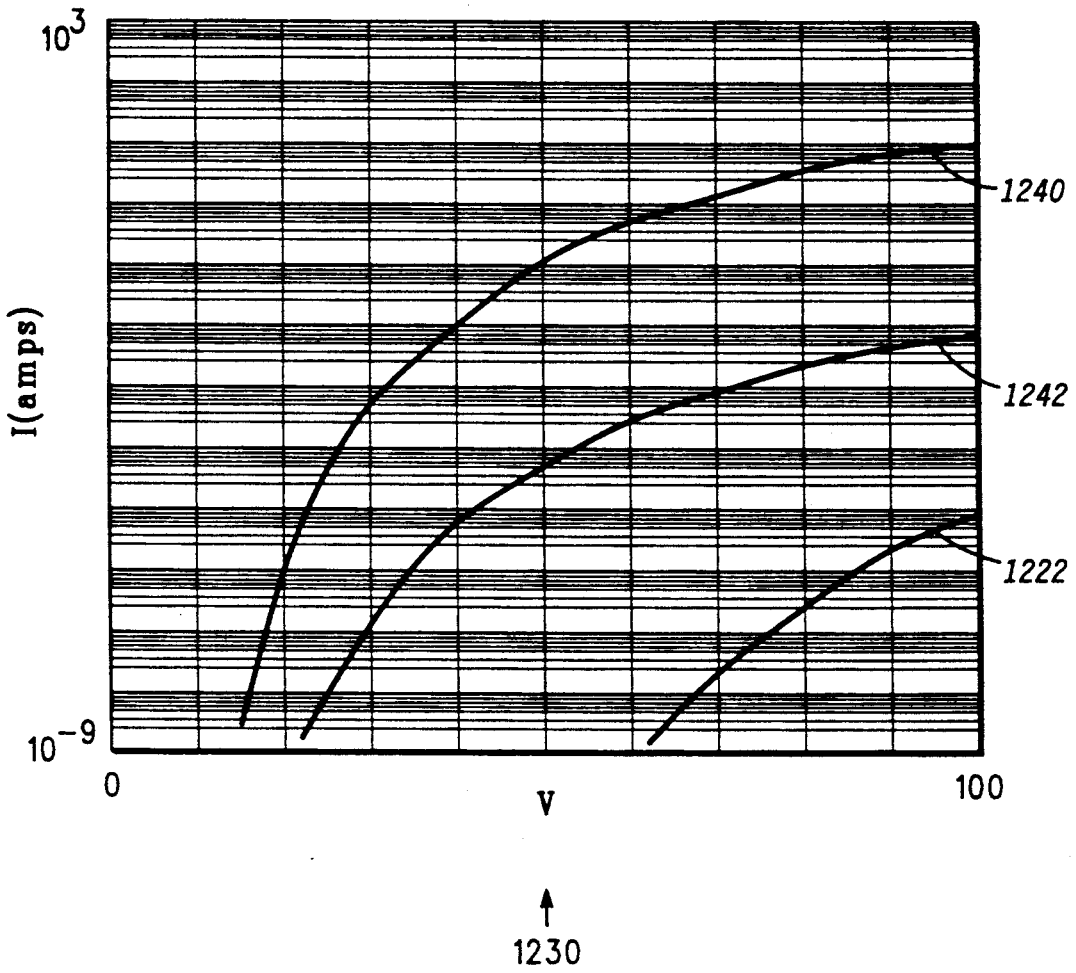

FIG. 12B is a graphical representation 1230 which corresponds to the leftmost portion of the graphical representation 1200 of FIG. 12A covering the applied voltage range from 0–100 volts. In FIG. 12B a first plot 1240 is a calculation for an electron source which employs a material exhibiting a work function of 1eV and a feature with a 500Å radius of curvature. A second plot 1242 is a calculation of an electron source which employs a material with a work function of 5eV and a feature with a 50Å radius of curvature. It is clear from FIG. 12B that an electron emitter formed in accordance with the parameters of the first plot 1240 provides significantly greater electron current than an electron source formed in accordance with the parameters associated with the calculation of the second plot 1242. From the calculations and illustrations of FIGS. 10–12B it is clear that by employing an electron source, which is formed of a material exhibiting a low surface work function, that significant improvements in emitted electron current is realized. It is further illustrated that by employing an electron source with a low surface work function that requirements for a feature of very small radius of curvature are relaxed. FIG. 9 is a side-elevational cross-sectional depiction of another embodiment of an electron device 900 similar to that described previously with reference to FIG. 8 wherein reference designators corresponding to similar features depicted in FIG. 8 are referenced beginning with the numeral "9". An electron source 902 is selectively formed to provide a substantially conical, or wedge shaped, region with an apex 909 exhibiting a small radius of curvature. Realization of an electron source in accordance with the present invention and employing the geometry of electron source 902 of FIG. 9 provides for reduction in device operating voltages due to the known electric field enhancement effects of sharp edges and pointed structures. Due to the electric field enhancement effects of geometric discontinuities of small radius of curvature such as sharp tips/edges electrons are preferentially emitted from the region at/near the location of highest electric field which in the instance of the device of FIG. 9 corresponds to electron source apex 909.

The electron device of FIG. 9 further employs an anode 903 as described previously with reference to FIGS. 5 & 6 to provide a fully addressable image generating device as described previously with reference to FIG. 8.

By employing a low work function material for electron source 902 such as, for example, type II-B diamond and by selectively orienting the low work function material such that a preferred crystallographic surface is exposed the requirement that apex 909 exhibit a very small radius of curvature is relaxed. In embodiments of prior art electric field induced electron emitter devices it is typically found, when considering micro-electronic electron emitters, that the radius of curvature of emitting tips/edges is necessarily less than 500Å and preferentially less than 300Å. For devices formed in accordance with the present invention it is anticipated that electron sources with geometric discontinuities exhibiting radii of curvature of approximately 5000Å will provide substantially similar electron emission levels as the structures of the prior art. This relaxation of the tip/edge feature requirement is a significant improvement since it provides for dramatic simplification of process methods employed to realize electron source devices.

While particular preferred embodiments of electron devices employing the electron sources of the present invention have been described it is anticipated that other electron device structures employing electron sources which utilize the electrical characteristics of type II-B diamond semiconductor material and other material with similar characteristics may be realized and will fall within the scope and spirit of the present invention.

What we claim is:

1. An electron device with an electron source comprising a single crystal diamond material which exhibits an inherent affinity to retain electrons disposed at/near a surface of the single crystal diamond material which is less than approximately 1.0 electron volt, the surface being substantially a preferred crystallographic orientation or plane of the single crystal diamond material.

2. The electron device of claim 1 wherein the material is diamond.

3. The electron device of claim 1 wherein the preferred crystallographic orientation is the 111 crystal plane.

4. An electron device with an electron source comprising a single crystal diamond material which exhibits an inherent negative affinity to retain electrons disposed at/near a surface of the single crystal diamond material, the surface being substantially a preferred crystallographic orientation or plane of the single crystal diamond material.

5. The electron device of claim 4 wherein the material is diamond.

6. The electron device of claim 4 wherein the preferred crystallographic orientation is the 111 crystal plane.

7. An electron device comprising:

an electron source formed of a layer of single crystal diamond material having a surface exhibiting very low affinity to retain electrons disposed at/near the surface of the material, the surface being substantially a preferred crystallographic orientation or plane of the single crystal diamond material;

an anode distally disposed with respect to the layer of single crystal diamond material and defining a free space between the anode and the surface of the layer of single crystal diamond material; and a voltage source coupled to the anode and the layer of single crystal diamond material, such that a voltage of appropriate polarity is provided between the anode and the surface of the layer of single crystal diamond material exhibiting very low electron affinity and substantially uniform electron emission into the free space between the anode and the surface of the layer of single crystal diamond material is initiated at the electron source with emitted electrons being collected at the anode.

8. The electron device of claim 7 wherein the very low electron affinity is less than approximately 1.0 electron volt.

9. The electron device of claim 7 wherein the preferred crystallographic orientation is the 111 crystal plane.

10. The electron device of claim 9 wherein the anode includes:

a substantially optically transparent faceplate material having a major surface;

a substantially optically transparent layer of conductive material disposed on the major surface of the faceplate material; and a layer of cathodoluminescent material disposed on the substantially optically transparent layer of conductive material, such that emitted electrons collected at the anode stimulate photon emission in the cathodoluminescent layer to provide a substantially uniform light source.

11. The electron device of claim 7 further including a supporting substrate having a major surface on which the layer of material is disposed.

12. The electron device of claim 11 wherein the supporting substrate includes a metallic conductor.

13. The electron device of claim 11 wherein the supporting substrate includes a semiconductor material.

14. An electron device comprising:

an electron source formed of a layer of single crystal diamond material having a surface with an affinity to retain electrons disposed at/near the surface of the material which is less than approximately zero electron volts, the surface being substantially a preferred crystallographic orientation of plane of the single crystal diamond material;

an anode distally disposed with respect to the layer of single crystal diamond material and defining a free space between the anode and the surface of the layer of single crystal diamond material; and an externally provided voltage source coupled to the anode and the layer of single crystal diamond material, such that a voltage of appropriate polarity is produced between the anode and the surface of the layer of single crystal diamond material exhibiting an electron affinity less than zero electron volts to initiate substantially uniform electron emission into the free space adjacent the electron source and collect emitted electrons at the anode.

15. The electron device of claim 14 wherein the preferred crystallographic orientation is the 111 crystal plane.

16. The electron device of claim 15 wherein the anode includes:

a substantially optically transparent faceplate material having a major surface;

a substantially optically transparent layer of conductive material disposed on the major surface of the faceplate material; and a layer of cathodoluminescent material disposed on the substantially optically transparent layer of conductive material, such that emitted electrons collected at the anode stimulate photon emission in the cathodoluminescent layer to provide a substantially uniform light source.

17. An electron device comprising:

a supporting substrate having a major surface;

a plurality of electron sources each formed of a layer of single crystal diamond material which exhibits a very low electron affinity at/near a surface of the single crystal diamond material, the surface being substantially a preferred crystallographic orientation or plane of the single crystal diamond material;

an anode distally disposed with respect to the plurality of electron sources and defining a free space between the anode and the surface of the layer of single crystal diamond material;

a plurality of conductive paths disposed on the major surface of the supporting substrate and selectively coupled to the plurality of electron sources;

a voltage source operably connected to the anode; and signal means connected to some of the plurality of electron sources, such that electrons are preferentially emitted from some electron sources of the plurality of electron sources into the free space between the anode and the surface of the single crystal diamond material and collected at areas of the anode substantially corresponding to the area of a selected electron source from which electrons have been emitted.

18. The electron device of claim 17 wherein the electron affinity of the material of the electron sources is less than approximately 1.0 electron volt.

19. The electron device of claim 17 wherein the preferred crystallographic orientation is the 111 crystal plane.

20. The electron device of claim 19 wherein the anode includes:

a substantially optically transparent faceplate material having a major surface;

a substantially optically transparent layer of conductive material disposed on the major surface of the faceplate material; and a layer of cathodoluminescent material disposed on the substantially optically transparent layer of conductive material, such that emitted electrons collected at selected areas of the anode stimulate photon emission in the cathodoluminescent layer to provide an image viewable at the faceplate.

21. An electron device comprising:

a supporting substrate having a major surface;

a plurality of electron sources each formed of a single crystal diamond material which exhibits an electron affinity of less than approximately zero electron volts at/near a first surface of the single crystal diamond material, the first surface being substantially a preferred crystallographic orientation or plane of the single crystal diamond material;

an anode vitally disposed with respect to the plurality of electron sources and defining a free space between the anode and the first surface of the single crystal diamond material;

a plurality of conductive paths disposed on the major surface of the supporting substrate and selectively operably coupled to the plurality of electron sources;

a voltage source connected to the anode; and signal means operably applied to the plurality of electron sources, such that electrons are preferentially emitted from some of the plurality of electron sources into free space between the anode and the surface of the single crystal diamond material and collected at areas of the anode substantially corresponding to the area of a selected electron source from which electrons have been emitted.

22. The electron device of claim 21 wherein the preferred crystallographic orientation is the 111 crystal plane.

23. The electron device of claim 22 wherein the anode includes:

a substantially optically transparent faceplate material having a major surface;

a substantially optically transparent layer of conductive material disposed on the major surface of the faceplate material; and a layer of cathodoluminescent material disposed on the substantially optically transparent layer of conductive material, such that emitted electrons collected at selected areas of the anode stimulate photon emission in the cathodoluminescent layer to provide a viewable image at the faceplate.

24. An electron device comprising:

a supporting substrate having a major surface;

an electron source formed of a single crystal diamond material which exhibits a very low electron affinity at/near a surface of the single crystal diamond material, the surface being substantially a preferred crystallographic orientation or plane of the single crystal diamond material;

an anode distally disposed with respect to the electron source and defining a free space between the anode and the surface of the single crystal diamond material;

an electron emission control electrode proximally disposed with resect to the electron source;

a voltage source connected to the anode; and signal means operably applied to the control electrode, such that electron emission from the electron source into the free space between the anode and the surface of the single crystal diamond material is controlled by preferentially selecting a voltage level of the signal means and wherein emitted electrons are collected at the anode.

25. The electron device of claim 24 wherein the electron affinity of the material of the electron source is less than approximately 1.0 electron volt.

26. The electron device of claim 24 wherein the signal means is further coupled to the electron source such that electron emission from the electron source is controlled by preferentially selecting a voltage level of the signal means and wherein emitted electrons are collected at the anode.

27. The electron device of claim 24 wherein the electron source is selectively shaped to provide a column formed substantially perpendicular to the supporting substrate.

28. The electron device of claim 24 wherein the electron source is selectively shaped to provide a cone having an apex.

29. The electron device of claim 24 wherein the electron source is selectively shaped to provide an edge.

30. An electron device comprising:

a supporting substrate having a major surface;

an electron source formed of a single crystal diamond material which exhibits an electron affinity of less than approximately zero electron volts at/near a surface of the single crystal diamond material, the surface being substantially a preferred crystallographic orientation or plane of the single crystal diamond material;

an anode distally disposed with respect to the electron source and defining a free space between the anode and the surface of the single crystal diamond material;

an electron emission control electrode proximally disposed with respect to the electron source;

a voltage source connected to the anode; and signal means operably applied to the control electrode, such that electron emission from the electron source into the free space between the anode and the surface of the single crystal diamond material is controlled by preferentially selecting the voltage level of the signal means operably applied to the control electrode and wherein some of any emitted electrons are collected at the anode.

31. The electron device of claim 30 wherein the signal means is further connected to the electron source such that electron emission from the electron source is controlled by preferentially selecting the voltage level of the signal means operably applied thereto and wherein some of any emitted electrons are collected at the anode.

32. The electron device of claim 30 wherein the electron source is selectively shaped to provide a column formed substantially perpendicular to the supporting substrate.

33. The electron device of claim 30 wherein the electron source is selectively shaped to provide a cone having an apex.

34. The electron device of claim 30 wherein the electron source is selectively shaped to provide an edge.

* * * * *

UNITED STATES PATENT AND TRADEMARK OFFICE

CERTIFICATE OF CORRECTION

PATENT NO. : 5,283,501

DATED : February 1, 1994

INVENTOR(S) : Zhu et al.

It is certified that error appears in the above-indentified patent and that said Letters Patent is hereby corrected as shown below:

Column 11, claim 14, line 33, delete "of" and insert "or" following the word "orientation".

Column 12, claim 21, line 52, delete "vitally" and insert "distally" following the word "anode".

Column 12, claim 21, line 64, insert "the" following the word "into".

Signed and Sealed this

Eighteenth Day of October, 1994

Bruce Lehman

*Attest:*

BRUCE LEHMAN

*Attesting Officer*

*Commissioner of Patents and Trademarks*